US011822263B2

(12) United States Patent
Wang et al.

(10) Patent No.: US 11,822,263 B2
(45) Date of Patent: Nov. 21, 2023

(54) CONSUMABLE CHIP AND CONTROL METHOD OF CONSUMABLE CHIP, CONSUMABLE MATERIAL, AND IMAGE FORMATION DEVICE

(71) Applicant: Zhuhai Pantum Electronics Co., Ltd., Zhuhai (CN)

(72) Inventors: Bo Wang, Zhuhai (CN); Haixiong Li, Zhuhai (CN); Aiguo Yin, Zhuhai (CN)

(73) Assignee: ZHUHAI PANTUM ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 17/849,959

(22) Filed: Jun. 27, 2022

(65) Prior Publication Data

US 2022/0326636 A1 Oct. 13, 2022

Related U.S. Application Data

(63) Continuation of application No. PCT/CN2020/131526, filed on Nov. 25, 2020.

(30) Foreign Application Priority Data

Dec. 31, 2019 (CN) ..... 201911416044.1

(51) Int. Cl.

| | |
|---|---|
| ***G03G 15/00*** | (2006.01) |
| ***G03G 15/08*** | (2006.01) |
| ***G03G 21/18*** | (2006.01) |

(52) U.S. Cl.

CPC ..... *G03G 15/0863* (2013.01); *G03G 21/1882* (2013.01); *G03G 2215/0697* (2013.01); *G03G 2221/1823* (2013.01)

(58) Field of Classification Search

USPC ..... 399/9, 13, 107, 110, 111

See application file for complete search history.

(56) References Cited

U.S. PATENT DOCUMENTS

| | | | | |
|---|---|---|---|---|
| 5,788,388 | A | 8/1998 | Cowger et al. | |
| 9,924,071 | B2 * | 3/2018 | Lee | G03G 15/0863 |

FOREIGN PATENT DOCUMENTS

| | | | |
|---|---|---|---|
| CN | 102320192 | A | 1/2012 |
| CN | 103465632 | A | 12/2013 |
| CN | 109298615 | A | 2/2019 |
| CN | 109346114 | A | 2/2019 |
| CN | 111158229 | A | 5/2020 |

OTHER PUBLICATIONS

The World Intellectual Property Organization (WIPO) International Search Report for PCT/CN2020/131526 dated Feb. 25, 2021 4 Pages (including translation).

* cited by examiner

*Primary Examiner* — Hoan H Tran

(74) *Attorney, Agent, or Firm* — ANOVA LAW GROUP, PLLC

(57) ABSTRACT

A consumable chip applied to a consumable includes a memory and a controller. The memory is used to store information of a consumable product of an image formation device. The controller is configured to control the consumable chip to generate a predetermined signal to cause the image formation device to perform a target operation according to the predetermined signal. The consumable chip is mounted at the consumable. The consumable is detachably mounted at the image formation device.

17 Claims, 5 Drawing Sheets

CONSUMABLE CHIP AND CONTROL METHOD OF CONSUMABLE CHIP, CONSUMABLE MATERIAL, AND IMAGE FORMATION DEVICE

CROSS-REFERENCE TO RELATED APPLICATIONS

This application is a continuation of International Application No. PCT/CN2020/131526, filed Nov. 25, 2020, which claims priority to Chinese Application No. 201911416044.1, filed Dec. 31, 2019, the entire content of all of which are incorporated herein by reference.

TECHNICAL FIELD

The present disclosure generally relates to the image formation technology field and, more particularly, to a consumable chip and a control method of the consumable chip, a consumable material, and an image formation device.

BACKGROUND

As a computer peripheral apparatus and the development of the imaging technology, an image formation device is broadly used due to advantages such as high speed and low cost of single-page imaging. According to different functions, the image formation device may include a printer, a copy machine, a multifunction machine, etc. According to different imaging principles, the image formation device may include a laser printer, an inkjet printer, a dot matrix printer, etc.

Since a low-cost imaging processor is used, the imaging controller is usually a system-on-chip (SoC). The SoC has relatively few resources such as a number of PINs, a number of pulse width modulation (PWM) waves, and a number of communication interfaces. The SoC of the image formation device sometimes has a problem of insufficient resources. To solve this problem, a controller CPU is usually added to the image formation device to share execution tasks of the SoC. Thus, the processing speed may be accelerated, but at the cost may be increased at the same time.

Therefore, it is desired to solve the problem of the insufficient resources in the image formation device without increasing the cost.

SUMMARY

Embodiments of the present application provide a consumable chip and a control method thereof, a consumable, an image formation device, and a storage medium, which are used to solve the problem of insufficient resources in an imaging controller of an image formation device in the prior art.

Embodiments of the present disclosure provide a consumable chip applied to a consumable for providing a consumable product to an image formation device. The consumable chip includes a memory and a controller. The memory is used to store information of the consumable product of the image formation device. The controller is configured to control the consumable chip to generate a predetermined signal to cause the image formation device to perform a target operation according to the predetermined signal. The consumable chip is mounted at the consumable. The consumable is detachably mounted at the image formation device.

Embodiments of the present disclosure provide a control method of a consumable chip, the consumable chip being mounted at a consumable, and the consumable being detachably mounted at an image formation device. The control method includes generating a predetermined signal to the image formation device to cause the image formation device to perform a target operation according to the predetermined signal.

Embodiments of the present disclosure provide a consumable includes a housing and a consumable chip. A consumable accommodation unit is arranged in the housing. A consumption product is accommodated in the consumable accommodation unit. The consumable chip is arranged at the housing. The consumable chip is applied to the consumable for providing the consumable product to an image formation device. The consumable chip includes a memory and a controller. The memory is used to store information of the consumable product of an image formation device. The controller is configured to control the consumable chip to generate a predetermined signal to cause the image formation device to perform a target operation according to the predetermined signal. The consumable chip is mounted at the consumable. The consumable is detachably mounted at the image formation device.

In the present disclosure, the controller of the consumable chip may be used to replace the imaging controller to generate the predetermined signal. Thus, the resources of the consumable chip may be sufficiently used. The problem of the insufficient resources of the imaging controller of the image formation device in the existing technology may be solved without increasing the cost. The consumable chip may have high reliability and be practical.

DETAILED DESCRIPTION OF THE EMBODIMENTS

In order to better understand the technical solutions of the present disclosure, embodiments of the present disclosure are described in detail below in connection with the accompanying drawings.

Figure 1:
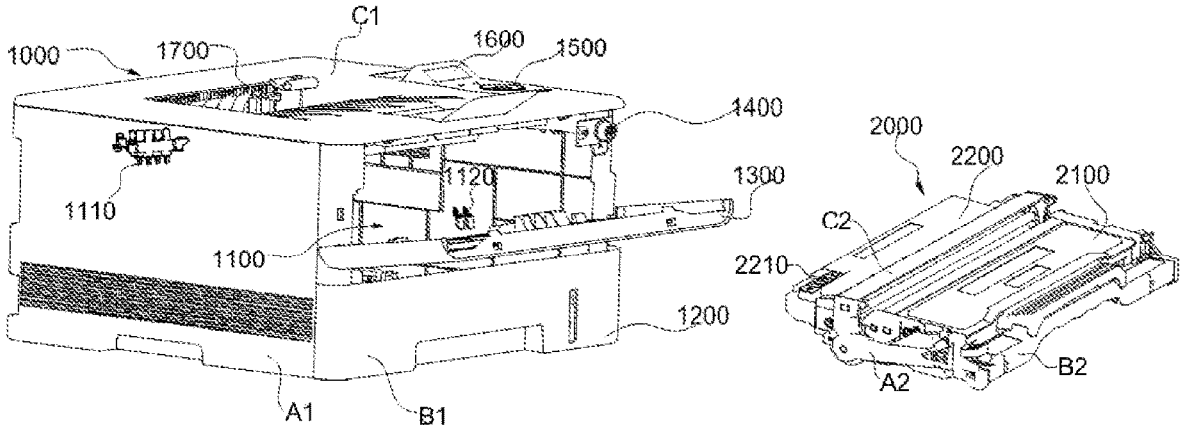
FIG. 1 is a schematic diagram of a connection between a consumable chip and an image formation device according to some embodiments of the present disclosure.
Figure 2:
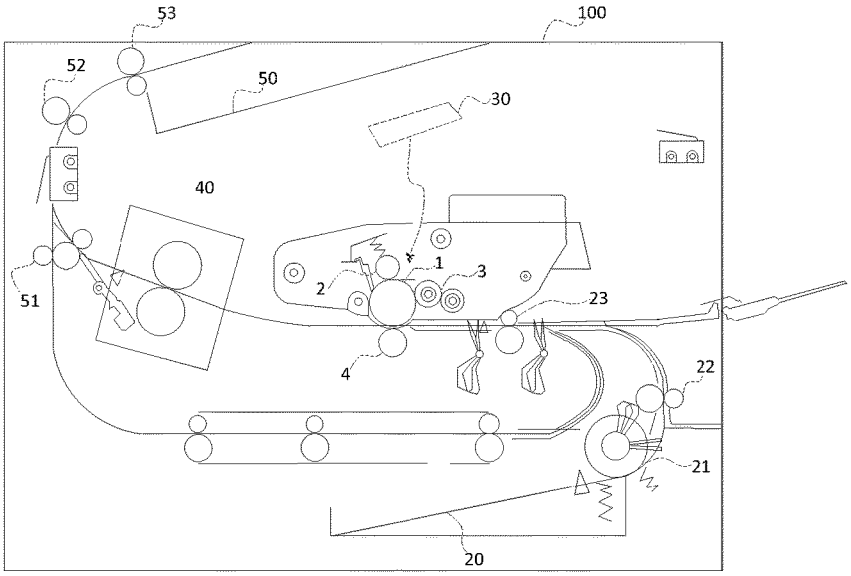
FIG. 2 is a schematic structural diagram of an image formation device according to some embodiments of the present disclosure.

FIGS. 1 and 2 introduce and illustrate a structure of an image formation device.

As shown in FIG. 1, for convenience of description, A1 is a left side surface of the image formation device, B1 is a front surface of the image formation device, C1 is an upper surface of the image formation device. A right side surface is opposite to A1. A rear surface is opposite to B1. A lower surface is opposite to C1. A2 is a left side surface of a process cartridge. B2 is a front surface of the process cartridge. C2 is an upper surface of the process cartridge. A right side surface is opposite to A2. A rear surface is opposite to B2. A lower surface is opposite to C2.

Embodiments of the present disclosure provide an image formation device 100, including a frame, a processing cartridge mounting member 1100, a paper cassette 1200, a paper conveying mechanism (not shown), and a gate cover 1300. The frame may be also referred to as a body or main body of the image formation device. The process cartridge mounting member 1100 is located in the frame. The paper cassette 1200 is located below the process cartridge mounting member 1100. The paper conveying mechanism (not shown) may be also arranged between the process cartridge mounting member 1100 and the paper cassette 1200. The gate cover 1300 is located at a front surface of the frame and connected by a pivot relative to the frame. When the gate cover 1300 is in an open state shown in FIG. 2, the process cartridge 2000 (i.e., consumables) is able to be mounted to or taken out from the process cartridge mounting member 1100. When the gate cover 1300 is rotated relative to the pivot toward the rear surface to a closed state, the process cartridge 2000 is stably mounted at the process cartridge mounting member 1100. A first communication circuit 1110 for contact communication with a first chip in the process cartridge 2000 and a second communication circuit 1120 for contact communication with a second chip in the process cartridge 2000 are also arranged in the process cartridge mounting member 1100. In embodiments of the present disclosure, the process cartridge 2000 may be a split type. That is, the process cartridge 2000 may include a developing cartridge 2100 for accommodating developer and a drum assembly 2200 for installing a photosensitive drum. The image formation device 100 of embodiments of the present disclosure further includes a power switch 1400, an operation panel 1500, a display panel 1600, and a paper discharge member 1700. The power switch is located at a front surface of the frame and close to the right side surface and the upper surface. The operation panel 1500, the display panel 1600, and the paper discharge member 1700 are located on the upper surface of the frame.

As shown in FIG. 2, the image formation device 100 further includes a transfer roller 4, a paper cassette 20, a paper feed roller (a pickup roller) 21, a conveyor roller 22, a correction roller 23, a laser 30, a fixing unit 40, a discharge paper cassette 50, a conveyor roller 51, a conveyor roller 52, and a conveyor roller 53, etc. The process cartridge 2000 includes a photosensitive drum 1, a charging roller 2, a developing roller 3, etc.

The paper cassette 20 may be configured to store paper P. The paper feed roller (pickup roller) 21 may be configured to convey the stored paper P to a conveying path. The conveyor roller 22 may be configured to convey paper P to a clamp area between the photosensitive drum 1 and the transfer roller 4. Imaged paper may be discharged to the discharge paper cassette 50 after passing through the fixing unit 40. The correction roller 23 may be configured to align and correct a feed edge of the paper to prevent the paper from skewing and affecting image formation quality.

The charging roller 2 may be configured to charge a surface of the photosensitive drum 1. The laser 30 emits a laser beam to form an electrostatic latent image on the surface of the photosensitive drum 1. The developing roller 3 may be configured to develop a toner image on the surface of the photosensitive drum 1. When paper P passes through the clamp area between the photosensitive drum 1 and the transfer roller 4, the photosensitive drum 1 may transfer the toner image formed on the surface of the photosensitive drum 1 to paper P under the action of the transfer roller 4. The fixing unit 40 may be configured to fix the toner image on paper P. Fixed paper P may be discharged through the charge paper cassette 50 and stacked by a convey function of the conveyor rollers 51-53.

Figure 3:
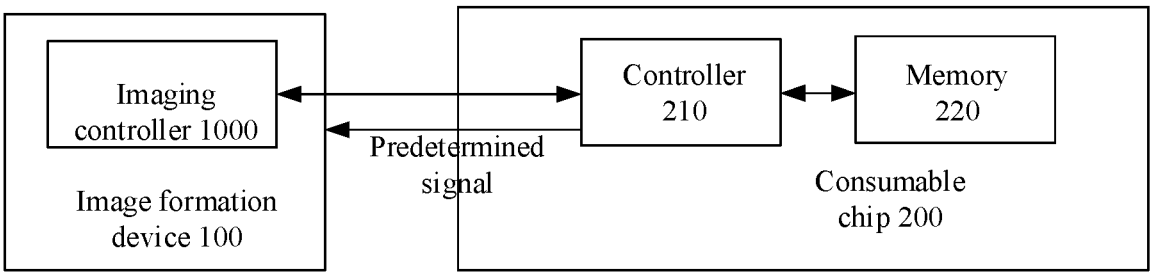
FIG. 3 is a schematic structural diagram of an image formation device according to some embodiments of the present disclosure.

FIG. 3 is a schematic diagram of a connection between a consumable chip 200 and an image formation device 100 according to some embodiments of the present disclosure. As shown in FIG. 3, the consumable chip 200 includes a controller 210 having an information processing function and a memory 220 configured to store consumable-related information. The image formation device 100 includes an imaging controller 1000 and a controller 210. For example, the imaging controller 1000 may be a system on chip (SoC) configured to control the imaging of the image formation device 100. The controller 210 may be communicatively connected to the imaging controller 1000. Thus, the data in the memory 220 may be transmitted to the image formation device 100, or the data in the image formation device 100 may be written into the memory 220.

The image formation device 100 may represent a device that is configured to, for example, print print data generated by a computer on a recording medium such as printing paper. The image formation device 100 may include but is not limited to, a copy machine, a printer, a fax machine, a scanner, and a multifunction peripheral that is configured to perform the above functions in a single apparatus. The image formation device 100 may include an inkjet printing image formation device 100, a laser printing image formation device, or another type of image formation device.

The consumable chip 200 may be arranged at the process cartridge 2000 (i.e., consumable). The consumable chip 200 of embodiments of the present disclosure may be applied to an ink cartridge/liquid container of an inkjet image formation device, or a drum/toner cartridge of a larger image formation device.

The memory 220 may be a non-volatile memory 220. The memory 220 may be connected to the controller 210. When the consumable chip 200 is powered off, the data stored in the memory 220 will not be lost. The non-volatile memory 220 may include a NOR flash (flash memory), a NAND flash (flash memory), an erasable programmable read-only memory (EEPROM), ferroelectric random access memory (FRAM), magnetic RAM (MRAM), a non-volatile static RAM (NVSRAM), etc.

The memory 220 may generally store related information such as a production date, a manufacturer, a device code, a chip serial number, a consumption information threshold, a consumable installation date, a consumable installed identification, a consumable color verification information, capacity information, and consumable information of the consumable chip. Some of the related information stored in the memory 220 listed above may be unnecessary, which is not limited to the present disclosure.

In the existing technology, the imaging controller 1000, such as an SoC, as a core controller of the image formation device 100, may be usually configured to perform processing an operation related to data transmission and reception, command transmission and reception, and engine control. For example, how an interface device (including but not limited to a USB port, a wired network port, a wireless network port, etc.) is called through an application program to send and receive data, a command, a state, etc., and also obtain a received printing parameter through the application program, and parse commands that are used to control the engine mechanism to perform specific functions, such as an LSU exposure parameter, a pickup roller rotation parameter, etc. Therefore, the image formation device 100 also requires more resources for the imaging controller 1000, such as a number of PINs, a number of pulse width modulation (PWM) waves, a communication interface, etc. Since the imaging controller in the existing technology often has the problem of insufficient resources, a controller CPU is usually added to the image formation device 100 to share the execution tasks of the imaging controller 1000. Thus, the processing speed is accelerated, but the cost is increased at the same time. Therefore, it is desired to solve the problem of insufficient resources of the imaging controller 1000 of the image formation device 100 in the existing technology.

Based on the problem, embodiments of the present disclosure provide a technical concept of using a consumable chip 200 to share the execution tasks of the imaging controller 1000, which can solve the problem of insufficient resources of the imaging controller 1000 of the image formation device 100 in the existing technology without increasing the cost.

In some embodiments, a controller 210 of the consumable chip 200 of embodiments of the present disclosure may be configured to generate a predetermined signal. Thus, the image formation device 100 may perform a target operation according to the predetermined signal. The consumable chip 200 may be mounted at the consumable. The consumable may be detachably mounted at the image formation device 100.

The consumable chip 200 may include a first port and a second port. The first port may be configured to communicate with the imaging controller 1000 in the image formation device 100. The second port may be configured to output the predetermined signal to the engine member in the image formation device 100 to control the engine member to perform the target operation corresponding to the predetermined signal. The target operation performed by the image formation device 100 includes, but is not limited to, controlling actions of the engine member and/or display of the display panel 1600 in the image formation device 100.

As shown in FIG. 2, the engine member of the image formation device 100 includes, but is not limited to, at least one of a motor (not shown in FIG. 2), a cleaning roller (not shown in FIG. 2), a charging roller 2, a laser 30 (LSU), a developing roller 3, a transfer roller 4, fixing roller (fixing unit 40), a feeding roller (pick-up roller) 21, a conveyor roller 22, conveyor rollers 51-53, a correction roller 23, a high-pressure plate (not shown in FIG. 2), an electromagnet (not shown in FIG. 2), or a relay (not shown in FIG. 2).

In the present disclosure, the controller 210 of the consumable chip 200 may be configured to replace the imaging controller 1000 to generate the predetermined signal. The resources of the consumable chip 200 may be sufficiently used, while the problem of insufficient resources of the imaging controller 1000 may be solved at the same time. Therefore, the problem of insufficient resources of the imaging controller 1000 of the image formation device 100 in the existing technology is solved without increasing the cost. Reliability is high, and practicability is strong.

The term "replace" of embodiments of the present disclosure may be an entire replacement or partial replacement of a whole control process of a functional circuit of the image formation device, or an entire replacement or partial replacement of a control process of a certain part of a functional circuit or a certain functional circuit, which is not limited by embodiments of the present disclosure.

The consumable chip 200 of the present disclosure is further described in embodiments of the present disclosure. Embodiments of the present disclosure may be combined with each other arbitrarily if embodiments of the present disclosure are not contradictory to each other.

In method 1, the imaging controller 1000 uses the consumable chip 200 to generate a pulse broadband modulation signal.

In some embodiments, the engine member may need to be controlled by a PWM signal. When the interface resources of the imaging controller 1000 are insufficient, in embodiments of the present disclosure, the consumable chip 200 may be used to generate the PWM signal needed by the engine member in the image formation device 100 to reduce the occupation of resources of the imaging controller 1000.

Figure 4:
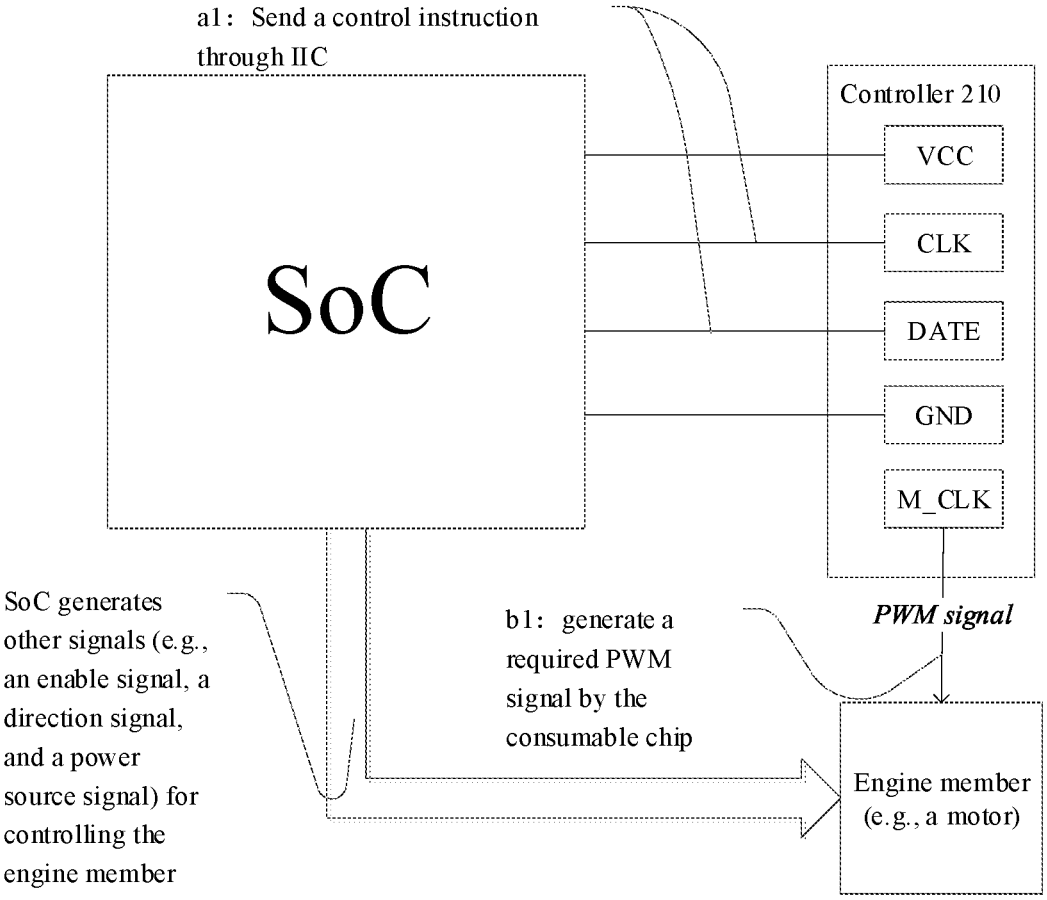
FIG. 4 is a schematic diagram showing an interaction between a consumable chip and an image formation device according to some embodiments of the present disclosure.

With reference to FIG. 4, method 1 includes the following processes.

At a1, the imaging controller 1000 (e.g., the SoC in FIG. 4) sends a control instruction to the controller 210 of the consumable chip 200. The control instruction includes parameter information for image formation engine control.

Before the imaging controller 1000 (e.g., SoC) sends the control instruction to the consumable chip 200, the imaging controller 1000 needs to control the consumable chip 200 to be powered on. In some embodiments, the consumable chip 200 may be powered by the image formation device 100.

In embodiments of the present disclosure, the imaging controller 1000 may be configured to pre-store a plurality of sets of image formation engine control parameters. The imaging controller 1000 may be configured to read the information of the consumables in the consumable chip 200 and/or attribute information stored in the imaging controller 1000 and/or an imaging command issued by the user through the operation panel of the terminal. The imaging controller 1000 may be further configured to match a corresponding target engine control parameter in the plurality of sets of image formation engine control parameters. The image formation engine control parameter may include but is not limited to at least one of a high voltage parameter, a fixing parameter, or an LSU optical power parameter. The high voltage parameter may include at least one of a charging high voltage parameter, a developing high voltage parameter, a transfer high voltage parameter, or a fixing high voltage parameter. The attribute information stored in the image formation device 100 may include, such as model, region, usage time, etc., of the image formation device 100. The imaging command may include information such as a paper type, a number of pages, and font density.

Taking the high voltage parameter as an example, the consumable chip 200 may be configured to send the information of the consumable to the SoC. The SoC may be configured to select the appropriate high voltage parameter according to various factors such as the font density, the paper type, the toner material, the printing environment, etc. The SoC may be further configured to send the control instruction having the high voltage parameter to the controller 210 of the consumable chip 200. After receiving the control instruction, the controller 210 may be configured to generate a PWM signal corresponding to the high voltage parameter to the high voltage plate in the image formation device 100. Thus, the high voltage plate may be configured to adjust the high voltage needed by the engine member (e.g., charging roller 2, developing roller 3, transfer roller 4, fixing roller (fixing unit 40), etc.)) during the entire imaging process. For example, if the toner material A needs a voltage of 1000V, the controller 210 may send a PWM signal with a duty ratio of 60% to the high voltage plate. If the toner material B needs a voltage of 500V, the controller 210 may send a PWM signal with a duty ratio of 10% to the high voltage plate. The PWM signal may include a cycle and a duty ratio. Different high voltage parameters may correspond to different PWM signals. By adjusting the cycle and the duty ratio of the PWM signal, the high voltage may be controlled.

The SoC may issue the control instruction through an integrated circuit bus (IIC, and also referred to as I2C Bus).

At b1, the consumable chip 200 generates the PWM signal required by the engine member (e.g., a motor) according to the control instruction to control the action of the engine member in the image formation device 100.

In some embodiments, another signal related to the control of the engine member, such as an enable signal, a direction signal, and a power signal, may be generated by the SoC. In some other embodiments, the another signal may be generated by the consumable chip 200, which is not limited by the present disclosure.

In method 2, the imaging controller 1000 generates a level control signal by using the consumable chip 200.

Before the imaging controller 1000 (e.g., SoC) sends a control instruction to the consumable chip 200, the imaging controller 1000 may first need to control the consumable chip 200 to be powered on. Generally, the consumable chip 200 may be powered by the image formation device 100.

A general printing process may include that the user issues a print command to the driver by operating the operation panel of the terminal, and the driver parses the print command to obtain data such as paper type, number of pages, font density, etc. The parsed data may be sent to the imaging controller 1000. The imaging controller 1000 may control the printing operation according to the printing state. Three printing states may include 1) a sleep state, in which the engine member wakes up the printer to perform a normal printing operation, 2) a standby state, in which the normal printing operation is directly performed, 3) a system errors detection state, in which the error is reported to return to the imaging controller 1000 and then return to the driver. The display panel of the terminal may eventually show a system error and does not perform the printing operation.

Figure 5:
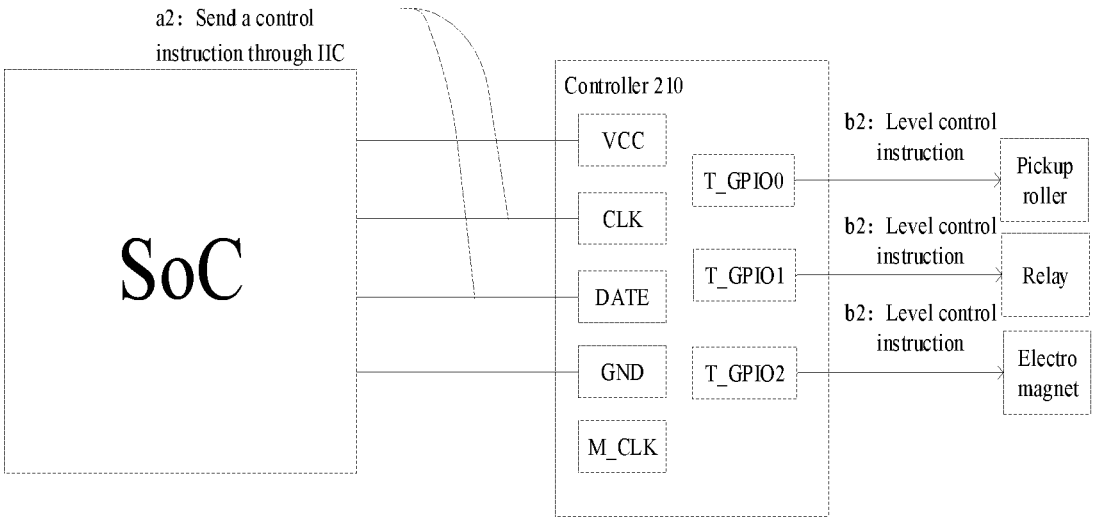
FIG. 5 is a schematic diagram showing an interaction between a consumable chip and an image formation device according to some embodiments of the present disclosure.

With reference to FIG. 5, the method includes the following processes.

At a2, the imaging controller 1000 (e.g., SoC) sends a control instruction to the controller 210 of the consumable chip 200. The control instruction carries the level control parameter information. The imaging controller 1000 determines a time sequence of the signals according to the state of the engine member, generates the level control parameter information, and generates the control instruction carrying the level control parameter information to the controller 210 of the consumable chip 200.

At b2, the consumable chip 200 generates a level control signal of the engine member (e.g., a pickup roller 21, a relay, an electromagnet) according to the control instruction to control an operation state of the engine member in the image formation device 100.

Figure 6:
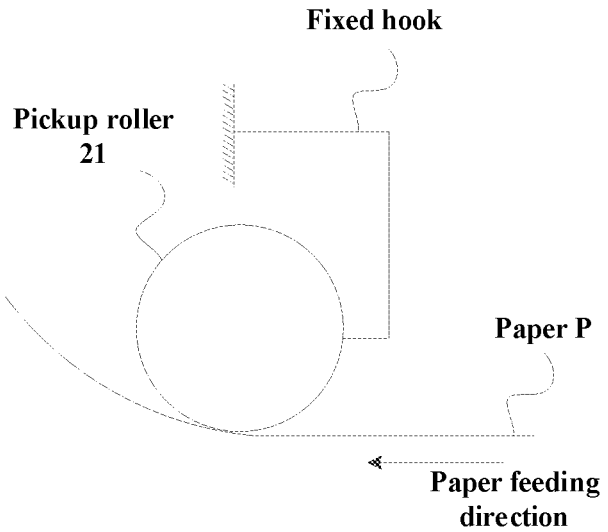
FIG. 6 is a schematic structural diagram of a paper feeding structure according to some embodiments of the present disclosure.

As shown in FIG. 6, by taking the control of the pickup roller 21 as an example, when the normal printing operation is performed, the image formation device 100 is heated, the laser 30 (LSU) starts laser scanning, the motor is started, and the engine member is applied with a high voltage. At this time, the consumable chip 200 provides a low-level signal to control a fixed hook at the pickup roller 21 to release the pickup roller 21 to perform a pickup operation.

In embodiments of the present disclosure, the consumable chip 200 may directly generate the level control signal to control the operation state of the engine member without occupying the resources of the imaging controller 1000. Thus, the problem of the insufficient sources of the imaging controller 1000 of the image formation device 100 in the existing technology without increasing the cost. The method has high reliability and strong practicability.

In method 3, the imaging controller 1000 controls the display of the display panel 1600 of the image formation device 100 by using the consumable chip 200.

In some embodiments, the consumable information may be stored in the memory 220 of the consumable chip 200. In the existing technology, current consumable state information may be displayed by using the consumable information recorded by the image formation device 100. In embodiments of the present disclosure, consumption information of the consumable may be transmitted to a panel controller according to the consumable information stored in the consumable chip 200 to control the current consumable state information displayed by the display panel 1600.

In the present disclosure, the current consumable state information displayed by the display panel 1600 may be controlled by the consumable chip 200, which can further reduce the resource occupation of the imaging controller 1000. Meanwhile, the current consumable state information displayed by the display panel 1600 may be determined by using the consumable information stored in the consumable chip 200. Thus, compared to the consumable information recorded in the image formation device 100, the current consumable state information may be more accurate.

In method 4, the consumable chip 200 is configured with a power-off protection mechanism.

The consumable chip 200 still performs read and write operations on the memory 220 when the image formation device 100 is powered on. When the consumable chip 200 has a sudden power failure, in order to avoid data loss, embodiments of the present disclosure provide an additional protection mechanism to the consumable chip 200. Thus, whether the image formation device 100 has an open cover may be detected more directly and quickly to reduce time lag. Therefore, internal data of the memory 220 of the consumable chip 200 may be effectively stored.

In some embodiments, the power-off protection mechanism may include the following processes. By adding a cover open detection function to the consumable chip 200, the consumable chip 200 may be directly used to detect whether the image formation device 100 has the open cover. If the cover is opened, the reading and writing of the consumable chip 200 may be stopped to protect the parameter of the consumable chip 200 from being damaged. Otherwise, the reading and writing of the consumable chip 200 may be continued.

Figure 7:
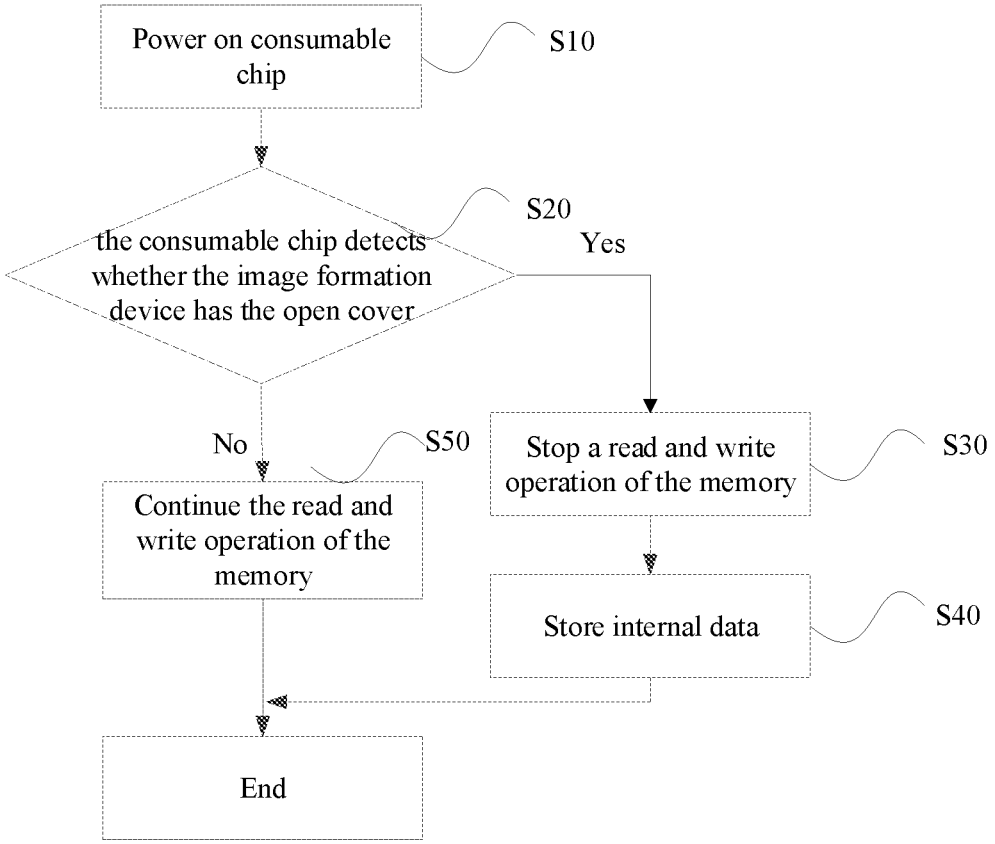
FIG. 7 is a schematic flowchart of a control method of a consumable chip according to some embodiments of the present disclosure.

As shown in FIG. 7, a control method of a consumable chip by using the controller 210 of the consumable chip 200 as an execution body includes the following processes.

At S10, the consumable chip is powered on.

At S20, the consumable chip detects whether the image formation device (e.g., a printer) has the open cover.

At S30, if the image formation device has the open cover, reading and writing operations of the memory are stopped.

At S40, the internal data is stored.

At S50, if the image formation device does not have the open cover, the reading and writing operations of the memory are continued.

A specific process includes as follows. A signal line of the switch sensor of the image formation device 100 may be connected to the consumable chip 200. The consumable chip 200 may detect whether the image formation device 100 has the open cover through the switch sensor. For example, if the consumable chip 200 receives a high level (e.g., a high-level signal), the image formation device 100 may not have the open cover. If the consumable chip 200 receives a low level (e.g., a low-level signal), the image formation device 100 may have the open cover. If the image formation device 100 is determined to have the open cover, the reading and writing of the memory 220 may be stopped to protect the parameter of the consumable chip 200 from being damaged. Otherwise, the reading and writing of the memory 220 may be continued.

In method 5, the memory 220 of the consumable chip 200 may store a plurality of sets of image formation engine control parameters.

A difference between Method 5 and Method 1 is that the image formation engine control parameters of Method 1 may be stored in the imaging controller 1000 or the storage unit corresponding to the imaging controller 1000. However, the image formation engine control parameters of Method 5 may be stored in the memory 220 of the consumable chip 200.

In some embodiments, the controller 210 of the consumable chip 200 may be configured to read the attribute information of the image formation device 100 in the storage unit of the image formation device 100 and/or obtain the imaging command issued by the terminal operation panel and/or the consumable information stored in the memory 220 of the consumable chip 200, and parameter rules stored in the consumable chip 200. Thus, the controller 210 of the consumable chip 200 may be configured to determine the corresponding target image formation engine control parameter from the plurality of sets of image formation engine control parameters. The controller 210 of the consumable chip 200 may be further configured to generate the PWM signal to the corresponding engine member based on the determined target image formation engine control parameter.

The attribute information of the image formation device 100 may include, for example, the model, region, and usage time of the image formation device 100. The image formation engine control parameter may include, but is not limited to, at least one of a high voltage parameter, a fixing parameter, or an LSU optical power parameter. The high voltage parameter may include at least one of a charging high voltage parameter, a developing high voltage parameter, a transfer high voltage parameter, or a fixing high voltage parameter. The imaging command may include information such as the paper type, the number of pages, and the font density.

For example, the image formation engine control parameter may be a high voltage parameter. When the controller 210 of the consumable chip 200 controls the high voltage, the controller 210 of the consumable chip 200 may obtain the corresponding high voltage parameter from the memory 220 in the consumable chip 200. Therefore, the consumable chip 200 may share the tasks of the SoC. Thus, the hardware resources of the consumable chip 200 may be sufficiently utilized, and the cost may be saved. At the same time, the memory 220 of the consumable chip 200 may store the high voltage parameter. The consumable chip 200 may be configured to send the PWM signal corresponding to the high voltage parameter to the high voltage plate. Thus, the response time may be reduced.

In the existing technology, the imaging controller (e.g., SoC) of the image formation device 100 may be configured to read the consumable parameter of the consumable chip 200 and/or the attribute information stored in the imaging controller and/or the imaging command issued by the operation panel of the image formation device 100, so as to determine which set may be used as the image formation engine control parameter. After the image formation device 100 is sold, if the parameter stored in the image formation device 100 needs to be updated, the firmware of the image formation device 100 needs to be updated. Thus, professional maintenance personnel may be required, and the update may also fail.

However, in embodiments of the present disclosure, the consumable chip 200 may be configured to store and determine the engine control parameter. The consumables may be used as consumption products and may continue to be produced after being used up. Therefore, newly generated consumables may be updated with the "image formation engine control parameter" at any time before leaving the factory. In connection with the latest consumption products or the latest debugging results, the latest image formation engine control parameter may be determined. The latest image formation engine control parameter may be used to improve the image quality of the image formation device 100.

Embodiments of the present disclosure provide a control method of a consumable chip. The control method may be applied to the consumable chip. The consumable chip may be mounted at the consumable. The consumable may be detachably mounted at the image formation device. The consumable may be configured to provide the consumption product to the image formation device. The method may include generating a predetermined signal to the image formation device so that the image formation device performs a target operation according to the predetermined signal.

In some embodiments, performing the target operation by the image formation device includes controlling the actions of the engine member of the image formation device and/or the display of the display panel.

In some embodiments, generating the predetermined signal to the image formation device so that the image formation device performs the target operation according to the predetermined signal includes outputting the predetermined signal to the engine member of the image formation device to control the engine member to perform the target operation corresponding to the predetermined signal.

In some embodiments, the memory may also store the plurality of sets of image formation engine control parameters. Generating the predetermined signal to the image formation device so that the image formation device performs the target operation according to the predetermined signal includes reading the attribute information of the image formation device stored in the image formation device, determining the corresponding target image formation engine control parameter based on the attribute information of the image formation device, and generating the predetermined signal according to the determined target image formation engine control parameter.

In some embodiments, the predetermined signal may include at least one of a PWM signal for controlling the motor, a PWM signal for controlling the developing roller, and a level control signal for controlling the electromagnet, a level control signal for controlling the pickup roller, a level control signal for controlling the relay, or a level control signal for controlling the electromagnet.

In some embodiments, the consumable chip may include a memory. The method further includes detecting whether the cover of the image formation device is in an open state.

If the cover of the image formation device is in an open state, the reading and writing operation of the memory may be stopped.

In embodiments of the present disclosure, the consumables may be detachably mounted at the image formation device. The consumable chip may be a chip mounted at the consumable. The consumable chip may be configured to generate the predetermined signal to the image formation device so that the image formation device may perform the target operation according to the predetermined signal. Thus, the problem of the insufficient resources of the imaging controller of the image formation device in the existing technology may be solved without increasing the cost.

For other embodiments and/or further technical details of the control method of the consumable chip, references may be made to the corresponding content of the consumable chip above, which is not repeated here.

Embodiments of the present disclosure provide a consumable chip. The consumable chip may be mounted at the consumable. The consumable may be detachably mounted at the image formation device. The consumable may be used to provide the consumption product to the image formation device. The consumable chip may include a generation circuit.

The generation circuit may be configured to generate the predetermined signal to the image formation device, so that the image formation device may perform the target operation according to the predetermined signal.

In some embodiments, performing the target operation by the image formation device includes controlling the actions of the engine member of the image formation device and/or the display of the display panel.

In some embodiments, the generation circuit may include a first generation sub-circuit.

The first generation sub-circuit may be configured to output the predetermined signal to the engine member of the image formation device, so as to control the engine member to perform the target operation corresponding to the predetermined signal.

In some embodiments, the memory may also store the plurality of sets of image formation engine control parameters. The generation circuit may include a read sub-circuit and a second generation sub-circuit.

The read circuit may be configured to output the predetermined signal to the engine member in the image formation device, so as to control the engine member to perform the target operation corresponding to the predetermined signal.

The second generation sub-circuit may be configured to determine the corresponding target image formation engine control parameter based on the attribute information of the image formation device and generate the predetermined signal according to the determined target image formation engine control parameter.

In some embodiments, the predetermined signal may include at least one of a PWM signal for controlling the motor, a PWM signal for controlling the developing roller, a level control signal for controlling the electromagnet, a level control signal for controlling the pickup roller, a level control signal for controlling the relay, or a level control signal for controlling the electromagnet.

In some embodiments, the consumable chip may further include a detection circuit and a stop circuit.

The detection circuit may be configured to detect whether the cover of the image formation device is in an open state.

The stop circuit may be configured to stop the reading and writing operation of the memory if the cover of the image formation device is in an open state.

For other contents of the consumable chips provided of embodiments of the present disclosure, references may be made to the corresponding description above, which is not repeated here.

Figure 8:
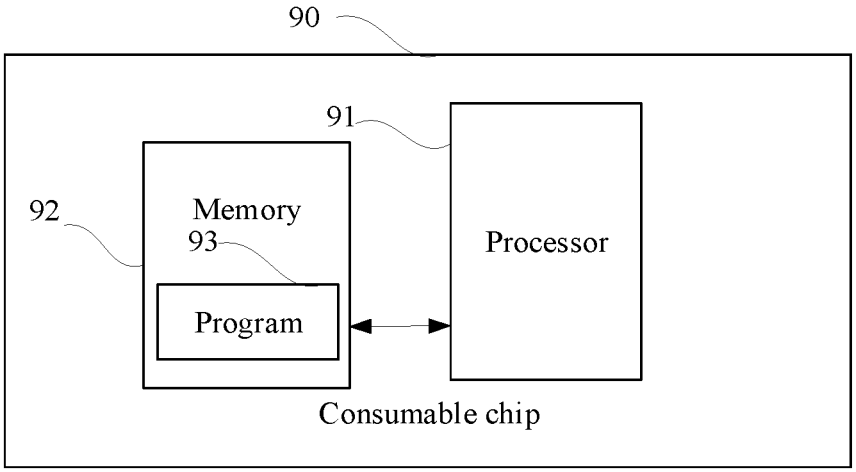
FIG. 8 is a schematic structural diagram of a consumable chip according to some embodiments of the present disclosure.
Figure 9:
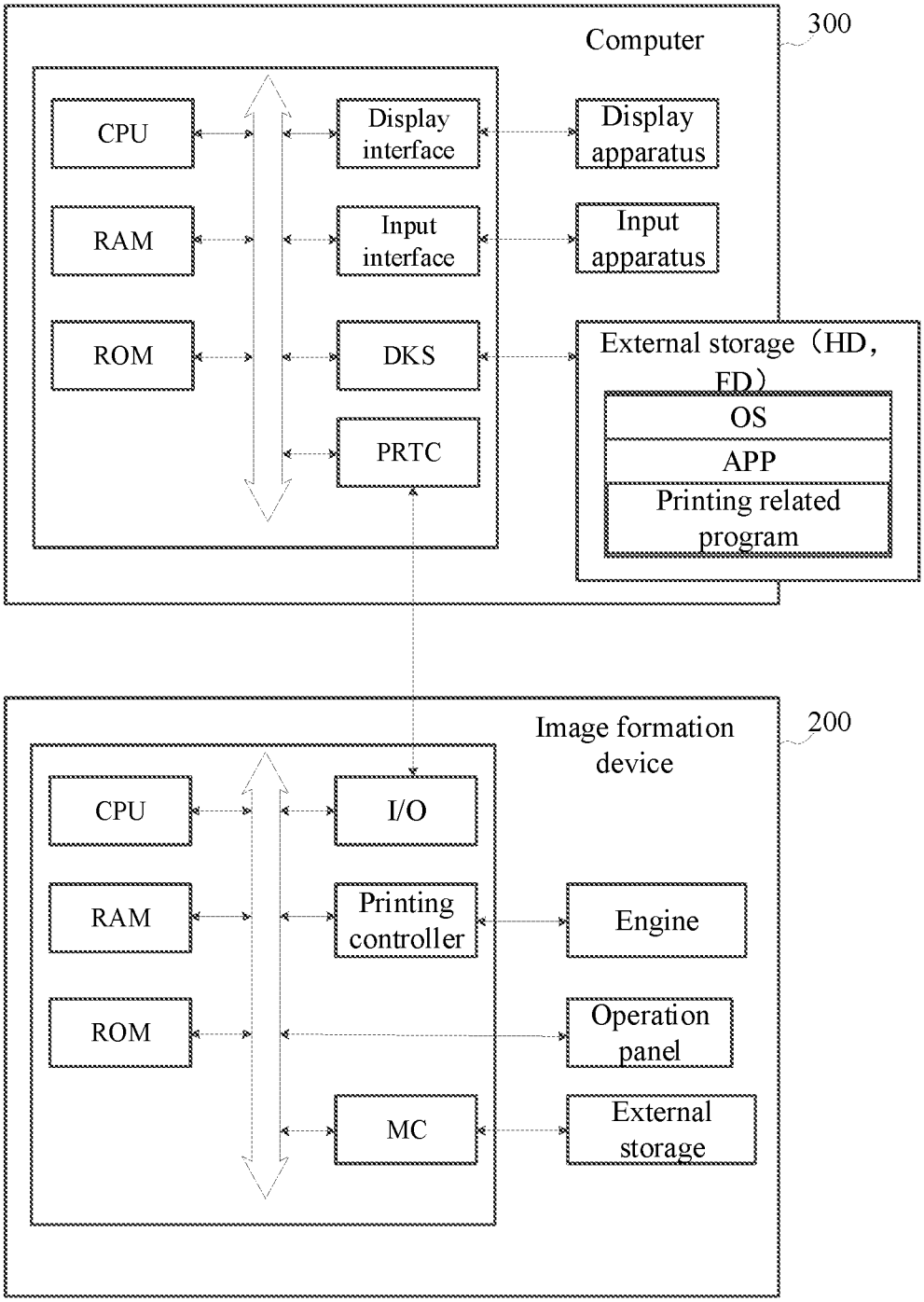
FIG. 9 is a schematic structural diagram of an image formation system according to some embodiments of the present disclosure.

As shown in FIG. 8, embodiments of the present disclosure provide a consumable chip 90. The consumable chip 90 of embodiments of the present disclosure includes a processor 91, a memory 92, and a computer program 93 stored in the memory 92 and executed by the processor 91. When the computer program 93 is executed by the processor 91, the processor 91 may be caused to implement a control method of the consumable chip of embodiments of the present disclosure. In some other embodiments, when the computer program is executed by the processor 91, the functions of the circuits/sub-circuits of the consumable chip 200 shown in FIG. 3 may be realized, which is not repeated here.

Embodiments of the present disclosure provide an image formation system. The image formation system may include an image formation device 200 and a data transmission apparatus for transmitting data to the image formation device 200. The transmission apparatus may include a terminal, e.g., a computer 300.

The image formation device 200 may include a printer or another device for printing and imaging, graphic copying, laser coding, or medical images. The computer 300 may include a terminal having a printing function such as a desktop computer, a laptop computer, a tablet computer, a mobile phone, and a personal digital assistant (PDA). The present disclosure does not limit specific forms of the image formation device and the computer. A connection between the computer 300 and the image formation device 200 may be a wireless connection such as Wi-Fi or Bluetooth or may be a wired connection through a USB data cable. In embodiments of the present disclosure, the USB communication manner may be improved. For another communication manner that has a similar problem as the USB communication manner, the technical solution of embodiments of the present disclosure may be adopted.

Embodiments of the present disclosure provide a consumable, including a housing and a consumable chip. A consumable accommodation unit may be arranged in the housing. The consumable accommodation unit may accommodate the consumption product. The consumable chip may be configured to execute the above control method. The consumable may include a developing cartridge. The consumable accommodation unit in the developing cartridge may accommodate the developer. The consumable may include a drum assembly. A photosensitive unit may be accommodated in the drum assembly. The photosensitive unit may be a consumable. For details, references may be made to the above specification, which is not repeated here.

Embodiments of the present disclosure provide an image formation device. The consumable of embodiments of the present disclosure may be mounted at the image formation device. For details, references may be made to the above specification, which is not repeated here.

Embodiments of the present disclosure provide a storage medium. The storage medium may include a stored program. When the program is executed, the apparatus where the storage medium is located may be controlled to execute the above control method executed by the consumable chip. The method executed by the consumable chip has been described above, which is not repeated here.

The above are only some embodiments of the present disclosure and are not intended to limit the present disclosure. Any modifications, equivalent replacements, and improvements made within the spirit and principle of the present disclosure shall be within the scope of the present disclosure.

What is claimed is:

1. A consumable chip applied to a consumable for communication to an image formation device, the consumable chip comprising:

a first port configured to communicate with an imaging controller of the image formation device;

a memory configured to store information of the image formation device;

a controller configured to generate a predetermined signal to cause the image formation device to perform a target operation according to the predetermined signal, wherein at a time of use, the consumable chip is mounted at the consumable, and the consumable is detachably mounted at the image formation device; and a second port configured to output the predetermined signal to an engine member of the image formation device to control the engine member to perform the target operation corresponding to the predetermined signal.

2. The consumable chip according to claim 1, wherein performing the target operation by the image formation device includes:

controlling an action of the engine member of the image formation device and/or display of a display panel.

3. The consumable chip according to claim 1, wherein:

the memory stores a plurality of sets of image formation engine control parameters; and the consumable chip is configured to:

read attribute information of the image formation device stored in the image formation device;

determine a corresponding target image formation engine control parameter based on the attribute information of the image formation device; and generate the predetermined signal according to the determined target image formation engine control parameter.

4. The consumable chip according to claim 1, wherein the predetermined signal includes at least one of:

a pulse width modulation (PWM) signal for controlling a motor, a PWM signal for controlling a developing roller, a level control signal for controlling an electromagnet, a level control signal for controlling a pickup roller, or a level control signal for controlling a relay.

5. The consumable chip according to claim 1, wherein the controller is further configured to:

detect whether a cover of the image formation device is open; and in response to the cover of the image formation device being open, stop a read and write operation of the memory.

6. A control method of a consumable chip, the consumable chip being mounted at a consumable, and the consumable being detachably mounted at an image formation device, the method comprising:

communicating with an imaging controller of the image formation device, by a first port of the consumable chip;

storing information of the image formation device, by a memory of the consumable chip;

generating a predetermined signal to cause the image formation device to perform a target operation according to the predetermined signal; and outputting the predetermined signal to an engine member of the image formation device to control the engine member to perform the target operation corresponding to the predetermined signal, by a second port of the consumable chip.

7. The control method according to claim 6, wherein performing the target operation by the image formation device includes controlling the action of an engine member of the image formation device and/or display of a display panel.

8. The control method according to claim 6, wherein:

the memory of the consumable chip further stores a plurality of sets of image formation engine control parameters; and generating the predetermined signal to the image formation device to cause the image formation device to perform the target operation according to the predetermined signal includes:

reading attribute information of the image formation device stored in the image formation device;

determining a corresponding target image formation engine control parameter based on the attribute information of the image formation device; and generating the predetermined signal according to the determined target image formation engine control parameter.

9. The control method of claim 6, wherein the predetermined signal includes at least one of:

a pulse width modulation (PWM) signal for controlling a motor, a PWM signal for controlling a developing roller, a level control signal for controlling an electromagnet, a level control signal for controlling a pickup roller, or a level control signal for controlling a relay.

10. The control method according to claim 6, further comprising:

detecting whether a cover of the image formation device is open, the image formation device including a memory; and in response to the cover of the image formation device being open, stopping a read and write operation of the memory.

11. A consumable comprising: a housing, a consumable accommodation unit being arranged in the housing; and a consumable chip arranged at the housing, the consumable chip including:

a first port configured to communicate with an imaging controller of the image formation device;

a memory configured to store information of the image formation device; and a controller configured to control the consumable chip to generate a predetermined signal to cause the image formation device to perform a target operation according to the predetermined signal, wherein at a time of use, the consumable chip is mounted at the consumable, and the consumable is detachably mounted at the image formation device; and a second port configured to output the predetermined signal to an engine member of the image formation device to control the engine member to perform the target operation corresponding to the predetermined signal.

12. The consumable according to claim 11, further comprising:

a developing cartridge, a developer being accommodated in the developing cartridge.

13. The consumable according to claim 11, further comprising:

a drum assembly including a photosensitive unit.

14. The consumable according to claim 11, wherein performing the target operation by the image formation device includes:

controlling an action of the engine member of the image formation device and/or display of a display panel.

15. The consumable according to claim 11, wherein:

the memory stores a plurality of sets of image formation engine control parameters; and the consumable chip is configured to:

read attribute information of the image formation device stored in the image formation device;

determine a corresponding target image formation engine control parameter based on the attribute information of the image formation device; and generate the predetermined signal according to the determined target image formation engine control parameter.

16. The consumable according to claim 11, wherein the predetermined signal includes at least one of:

a pulse width modulation (PWM) signal for controlling a motor, a PWM signal for controlling a developing roller, a level control signal for controlling an electromagnet, a level control signal for controlling a pickup roller, or a level control signal for controlling a relay.

17. The consumable according to claim 11, wherein the controller is further configured to:

detect whether a cover of the image formation device is open;

in response to the cover of the image formation device being open, stop a read and write operation of the memory.

* * * * *